US006774749B2

(12) United States Patent
Raabe et al.

(10) Patent No.: US 6,774,749 B2
(45) Date of Patent: Aug. 10, 2004

(54) TRIP CROSS BAR AND TRIP ARMATURE ASSEMBLY FOR A CIRCUIT BREAKER

(75) Inventors: Rodney Raabe, Cedar Rapids, IA (US); James Tipton, Cedar Rapids, IA (US); Jason Colsch, Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 112 days.

(21) Appl. No.: 09/956,221

(22) Filed: Sep. 19, 2001

(65) Prior Publication Data

US 2003/0053274 A1 Mar. 20, 2003

(51) Int. Cl.[7] ..... H01H 75/12
(52) U.S. Cl. ..... 335/35; 335/23; 335/38
(58) Field of Search ..... 335/23–25, 35–42, 335/165–176, 132, 202

(56) References Cited

U.S. PATENT DOCUMENTS

| | | | | |
|---|---|---|---|---|
| 4,431,877 | A | * | 2/1984 | Heft et al. |
| 4,635,011 | A | * | 1/1987 | Leone et al. |
| 4,644,307 | A | * | 2/1987 | Tanimoto |
| 4,716,265 | A | * | 12/1987 | Fujii et al. |
| 4,724,411 | A | * | 2/1988 | Matsumoto et al. ..... 335/172 |
| 4,791,393 | A | * | 12/1988 | Flick et al. |
| 4,841,266 | A | * | 6/1989 | Wulff |
| 4,888,570 | A | * | 12/1989 | Toda ..... 335/167 |
| 5,220,488 | A | * | 6/1993 | Denes |
| 5,250,918 | A | * | 10/1993 | Edds et al. ..... 335/35 |
| 5,381,120 | A | * | 1/1995 | Arnold et al. ..... 335/35 |
| 5,440,284 | A | * | 8/1995 | Ferullo et al. |
| 5,581,219 | A | * | 12/1996 | Nozawa et al. ..... 335/132 |
| 5,793,270 | A | * | 8/1998 | Beck et al. |
| 5,910,760 | A | * | 6/1999 | Malingowski et al. |
| 5,926,081 | A | * | 7/1999 | DiMarco et al. |
| 6,194,982 | B1 | * | 2/2001 | Mrenna et al. ..... 335/35 |
| 6,407,653 | B1 | * | 6/2002 | Zindler et al. ..... 335/6 |

FOREIGN PATENT DOCUMENTS

| | | | |
|---|---|---|---|
| DE | 2128633 | * | 1/1973 |
| DE | 4404706 A1 | * | 9/1994 |
| EP | 0772195 A2 | * | 11/1996 |
| JP | 04-280026 | * | 10/1992 |
| JP | 09-161641 | * | 6/1997 |
| JP | 2000-003655 | * | 1/2000 |
| WO | WO 01/16986 A1 | * | 3/2001 |

OTHER PUBLICATIONS

Description of Terasaki Circuit Breaker—Te21–43, as early as 1995, 1 page, (no date).

Description of Fuji Circuit Breaker—F–9–11, as early as 1995, 2 pages, (no date).

(List continued on next page.)

*Primary Examiner*—Lincoln Donovan
(74) *Attorney, Agent, or Firm*—Larry I. Golden

(57) ABSTRACT

A circuit breaker for interrupting the flow of current upon the detection of excess current or temperature is provided which comprises a housing, a trip armature plate, a trip armature frame, and a bias spring. The trip armature plate has at least two pivot tabs extending laterally on opposite edges that are inserted into a pivot elongated slot, which is located at an open end of the trip armature frame, and a pivot aperture, which is located at the opposite end of the trip armature frame, respectively. A bias spring is used for securing the pivot tabs into the pivot elongated slot and the pivot aperture, and for urging the trip armature plate pivotably outwardly about the pivot tabs away from the trip armature frame. The circuit breaker also comprises a trip cross bar having at least two fingers that are used to engage optional circuit breaker accessories and that are located asymmetrically to allow the interchangeability of the accessories. During top down assembly, the trip cross bar is the last component that is assembled into the circuit breaker in order to allow the easy installation of other components, including the trip armature frame and trip armature plate.

3 Claims, 6 Drawing Sheets

OTHER PUBLICATIONS

Description of Mitsubishi Circuit Breaker—M–21–6, as early as 1995, 2 pages, (no date).
Description of Toshiba Circuit Breaker—T–9–2, as early as 1995, 1 page, (no date).
Patent Abstract for Germany—De 4404706 A, 1 page. (see B03), (no date).
Patent Abstracts for Japan—Publ. No. 04–280026, Oct. 6, 1992, 1 page. (see B04), (no date).
Patent Abstracts for Japan—Publ. No. 2000–003655, Jan. 7, 2000, 1 page. (see B06), (no date.
Patent Abstract for Japan—JP 9161641 A, 1 page. (see B05), (no date).
Photographs of Terasaki Circuit Breaker—Te21–43. Photographs 1–11, 11 pages, (no date).
Photographs of Fuji Circuit Breaker—F–9–11, Photographs 12–29, 18 pages, (no date).
Photographs of Mitsubishi Circuit Breaker—M–21–6, Photographs 30–48, 19 pages, (no date).
Photographs of Toshiba Circuit Breaker—T–9–2, Photographs 49–61, 13 pages, (no date).

* cited by examiner

TRIP CROSS BAR AND TRIP ARMATURE ASSEMBLY FOR A CIRCUIT BREAKER

FIELD OF THE INVENTION

This invention is directed generally to circuit breakers, and more specifically, to the trip cross bar and the trip armature assembly components required to operate the tripping mechanism of a circuit breaker.

BACKGROUND OF THE INVENTION

Circuit breakers are well-known and commonly used to provide automatic circuit interruption to a monitored circuit when undesired overcurrent conditions occur. Some of these overcurrent conditions include, but are not limited to, overload conditions, ground faults, and short-circuit conditions. The current interruption is usually achieved by having a movable contact, which is attached to a movable blade, that separates from a stationary contact, which is attached to a stationary arm or blade. A tripping mechanism is the component that drives the tripping action using, in general, a spring-biased latch mechanism to force the movable blade, and therefore the movable contact, away from the stationary contact.

A part of the tripping mechanism is the trip cross bar that is used as a means to activate a blade mechanism, which automatically moves the movable blade to an open position. The trip cross bar is generally mounted on a frame that is connected directly or indirectly to the circuit breaker housing. For example, in a prior art circuit breaker the trip cross bar must first be riveted to a latch and only then it is possible to attach the trip cross bar to a supporting fitting. Once attached to the supporting fitting the trip cross bar is rotatably supported by a supporting pin which is held in place by the supporting fitting and a side plate of a switch mechanism. A need exists for an improved circuit breaker design that requires fewer parts, is easier to assemble, and is compact in design. Given the position of the trip cross bar in the circuit breaker, the trip cross bar design may affect how other components of the circuit breaker are assembled and, also, how other components are shaped and dimensioned. In particular, space is needed inside the circuit breaker to assemble the various components of the circuit breaker, and the trip cross bar gets in the way.

It is, therefore, an object of this invention to provide easy assembly of a circuit breaker by providing a trip cross bar that is the last component to be assembled, using a top-down assembly method.

One type of tripping mechanism used in a circuit breaker is a thermal tripping unit. When the current reaches a predetermined value, which is generally based on a percentage of the rated current for a period of time, the tripping unit is activated. The tripping unit passes the current through and thereby heats a bimetal, hence, causing the bimetal to bend. As a result, the bimetal, now bent, contacts and activates the trip cross bar. The current also passes through a magnetic trip armature which causes it to rotate into engagement with a magnetized pole, activating the trip cross bar. The trip cross bar, when activated, causes a latch mechanism to rotate on movable blade away from the stationary contact. The end result is that the circuit breaker is in a tripped position, opening the circuit. However, an improved manner of connecting the magnetic trip armature to the armature supporting frame permits the development of a smaller, more efficient, and more economical circuit breaker.

It is, therefore, another object of this invention to provide a magnetic trip armature that can be easily and simply connected to an armature return spring and to an armature supporting frame. This is accomplished by having the magnetic trip armature snap into the armature supporting frame and by being held secure in all orientations by the armature return spring, using a top down assembly wherein late point assembly allows other parts to be placed in the circuit breaker without interference.

SUMMARY OF THE INVENTION

Briefly, in accordance with the foregoing, a circuit breaker for interrupting the flow of current upon the detection of excess current or temperature is provided which comprises a housing, a trip armature plate, a trip armature frame, and a bias spring. The trip armature plate has at least two pivot tabs extending laterally on opposite edges that are inserted into a pivot elongated slot, which is located at an open end of the trip armature frame, and a pivot aperture, which is located at the opposite end of the trip armature frame, respectively. A bias spring is used for securing the pivot tabs into the pivot elongated slot and the pivot aperture, and for urging the trip armature plate pivotably outwardly about the pivot tabs away from the trip armature frame.

Additionally, a trip cross bar is provided in the circuit breaker. The trip cross bar can have, optionally, two fingers that are used to engage optional circuit breaker accessories and that are located asymmetrically to allow the interchangeability of the accessories. During top down assembly, the trip cross bar is the last component that is assembled into the circuit breaker in order to allow the easy installation of other components, including the trip armature frame and trip armature plate. The connecting location of the trip cross bar is in a central position for allowing actuation of the trip cross bar by a central, left, or right bimetal.

DETAILED DESCRIPTION OF THE ILLUSTRATED EMBODIMENT

Figure 1:
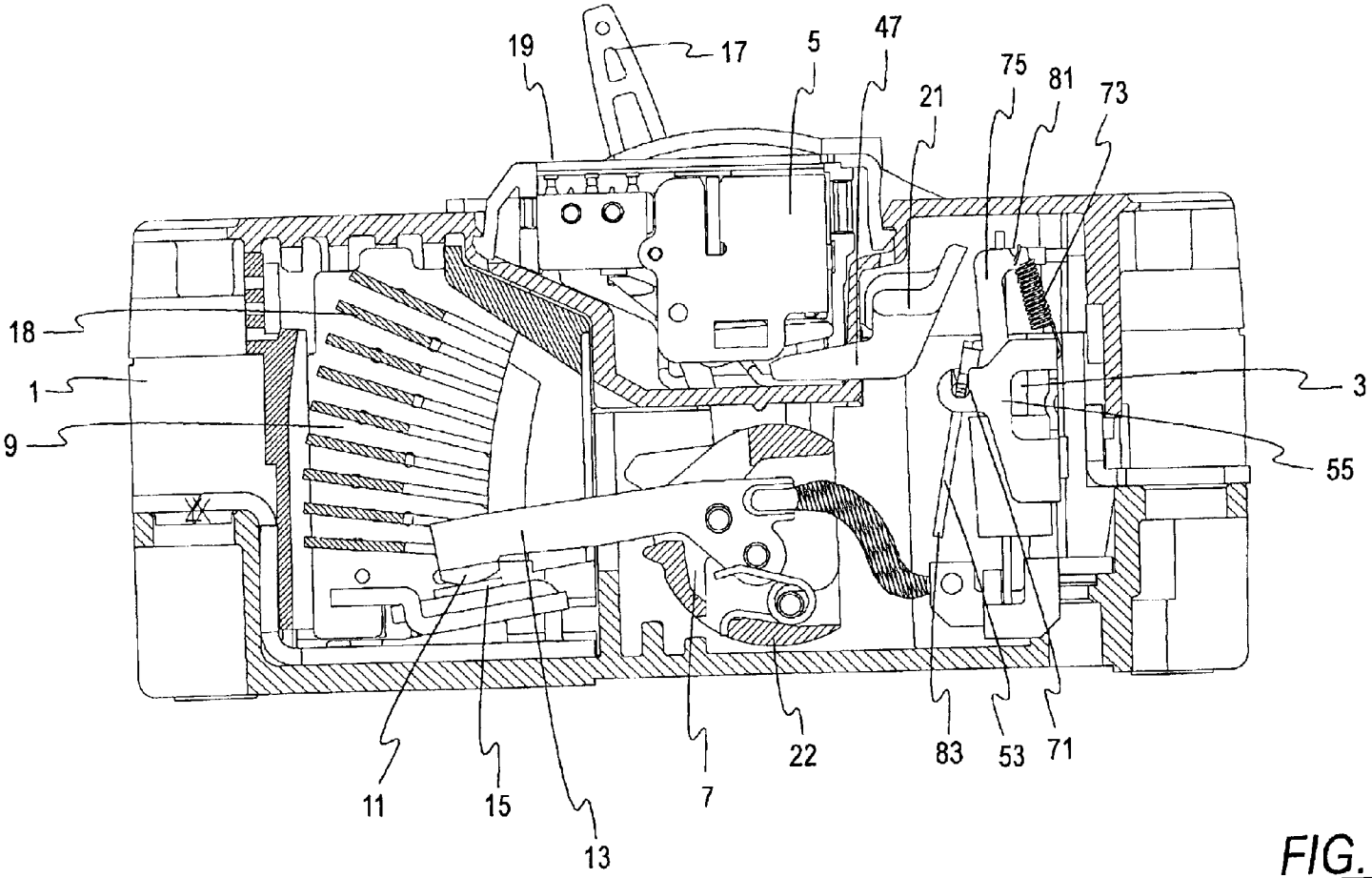
FIG. 1 is a cross-sectional view of a circuit breaker embodying the present invention, shown in the closed position.

Turning now to the drawings, and referring initially to FIGS. 1, 2, 3, and 4, a circuit breaker 1 is shown in the "closed," "open," "blown-open," and "tripped" positions, respectively. The circuit breaker 1 contains, generally, a tripping mechanism 3, a handle mechanism 5, a blade mechanism 7, and an arc-extinguishing mechanism 9.

More specifically, when the circuit breaker 1 is in the "closed" position, as shown in FIG. 1, a movable contact 11 attached to a blade 13, which in turn is part of the blade mechanism 7, engages a stationary contact 15. The connection that occurs between the movable contact 11 and the stationary contact 15 results in normal operation of the electrical system to which the circuit breaker 1 is connected. A handle 17 is a part of the handle mechanism 5 and protrudes through the circuit breaker's housing for manually resetting the circuit breaker 1. The handle 17 can also serve as a visual indication of the status of the circuit breaker 1. In the "closed" position, see FIG. 1, the handle 17 is shown at the closed edge 19 of a handle slot, which is at the counterclockwise end of the handle slot as viewed in FIG. 1. Also, a trip cross bar 21, which is part of the tripping mechanism 3, is shown in its untripped position having the long surface of a finger 47 positioned horizontally.

Figure 2:
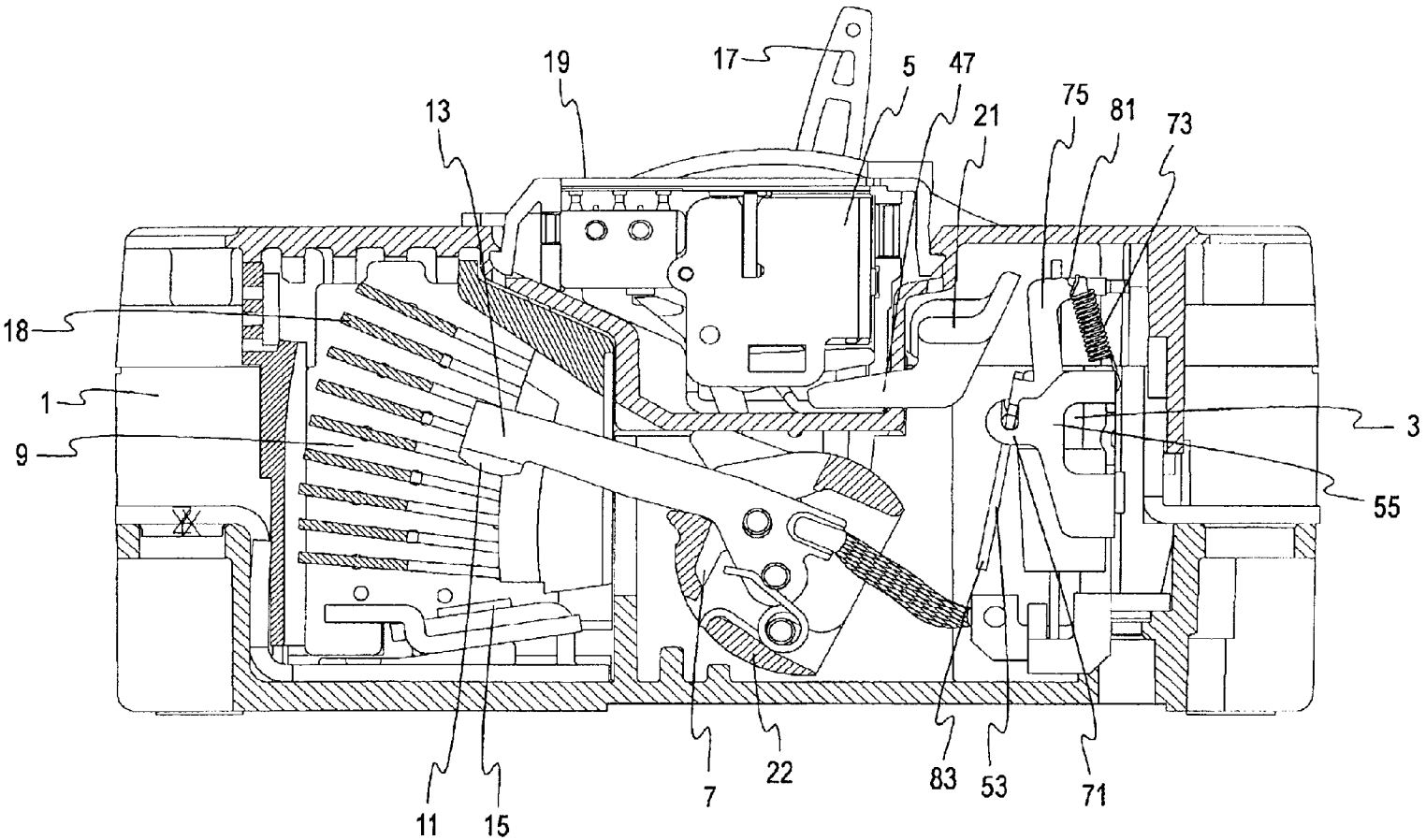
FIG. 2 is a cross-sectional view of the circuit breaker of FIG. 1, shown in the open position.

The "open" position is a manually controlled position that allows an operator of circuit breaker 1 to interrupt the flow of current by separating the movable contact 11 from the stationary contact 15. The operator moves the handle 17 to the most clockwise position, as shown in FIG. 2. In this position the blade 13 swings in a clockwise direction so that the movable contact 11 is spaced well away from the stationary contact 15. The trip cross bar 21 remains unchanged from its closed position.

Figure 3:
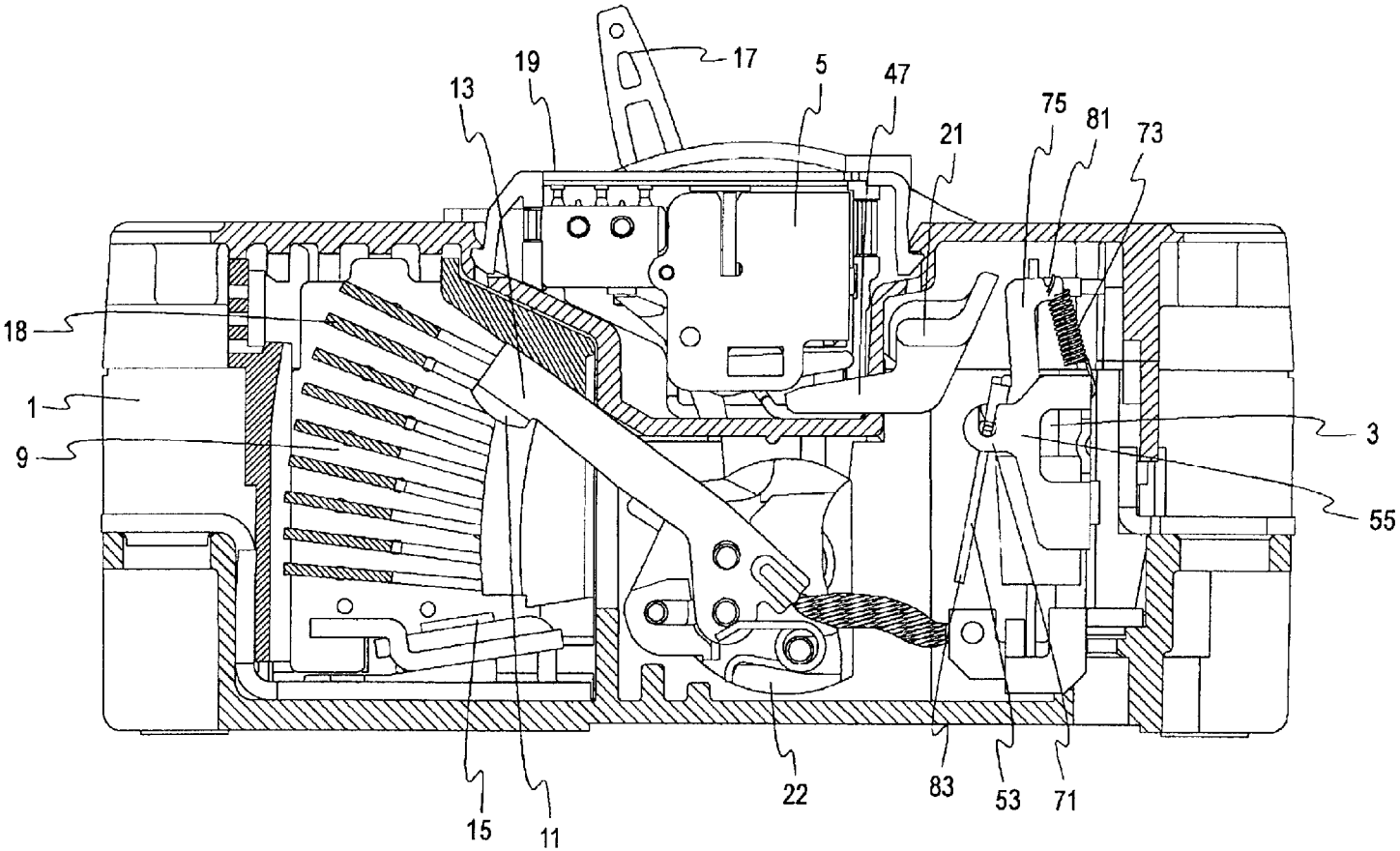
FIG. 3 is a cross-sectional view of the circuit breaker of FIG. 1, shown in the blown-open position.

In the "blown-open" position, shown in FIG. 3, an electric current that has a higher value than the preset acceptable threshold by a certain percentage, i.e., 35%, produces electromagnetic forces which are high enough to overcome pre-applied forces on the blade 13. This causes the blade 13 to swing across the arc-extinguishing mechanism 9 to the maximum clockwise position of the blade 13. In this position the blade housing 22 and trip cross bar 21 remain in the same position as in the "closed" and "open" positions. Similarly, the handle 17 remains in the same position as in the "closed" position.

Figure 4:
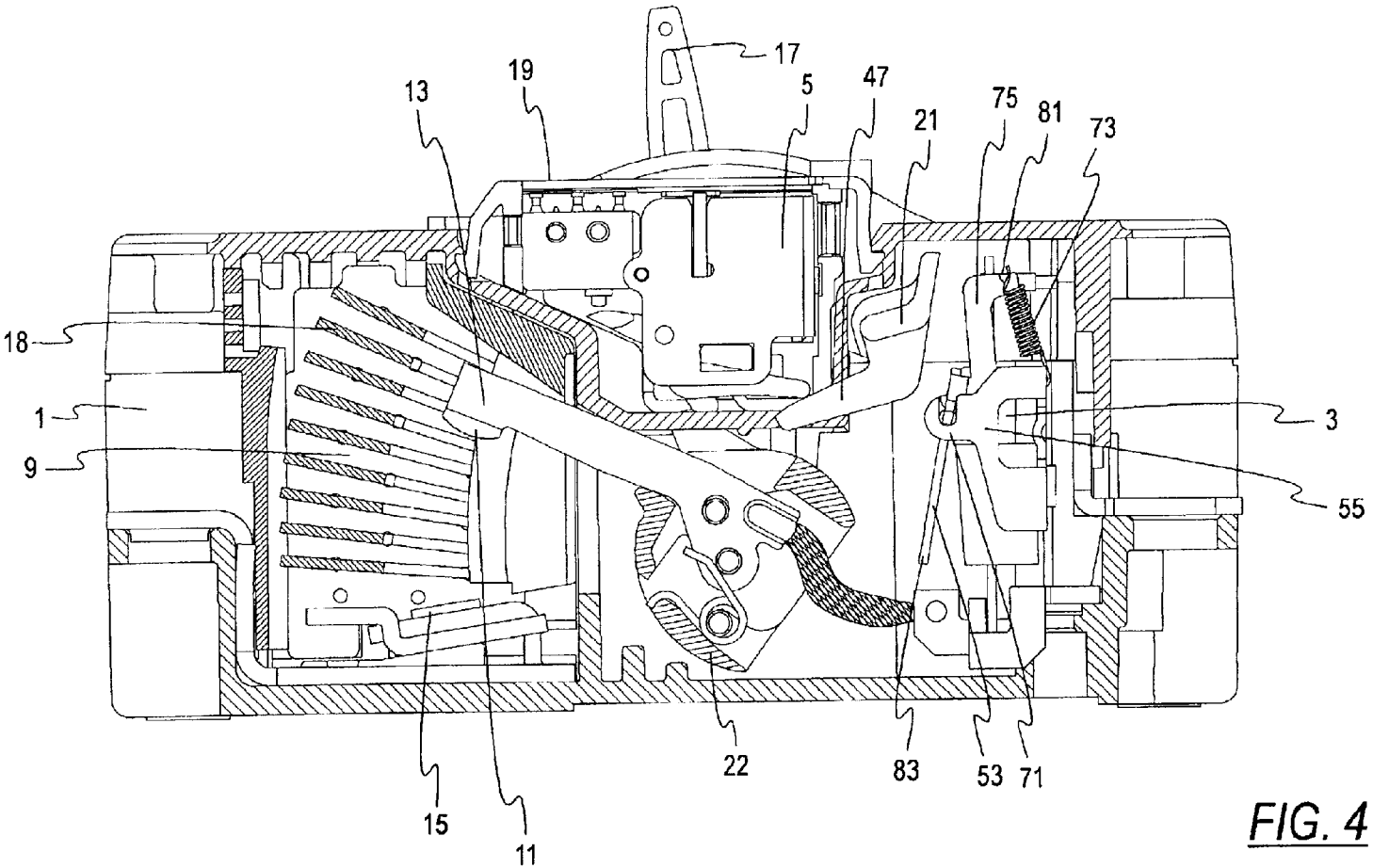
FIG. 4 is a cross-sectional view of the circuit breaker of FIG. 1, shown in the tripped position.

The "tripped" position is caused by the presence of a higher current than the assigned current for the circuit breaker 1 over a specified period of time. The exposure of the circuit breaker 1 to a longer period of high current activates the tripping mechanism 3 that, as shown in FIG. 4, causes the blade 13 and the blade housing 22 to swing across the arc-extinguishing mechanism 9 in the clockwise direction, as viewed in FIG. 4, and therefore interrupt the current flow. The handle 17 remains in an intermediate position between the "closed" and "open" positions, wherein the operator must reset the circuit breaker 1 by first moving the handle 17 to its "open" position before moving the handle 17 to its "closed" position. In this position the trip cross bar 21 is shown in its activated state.

Figure 5:
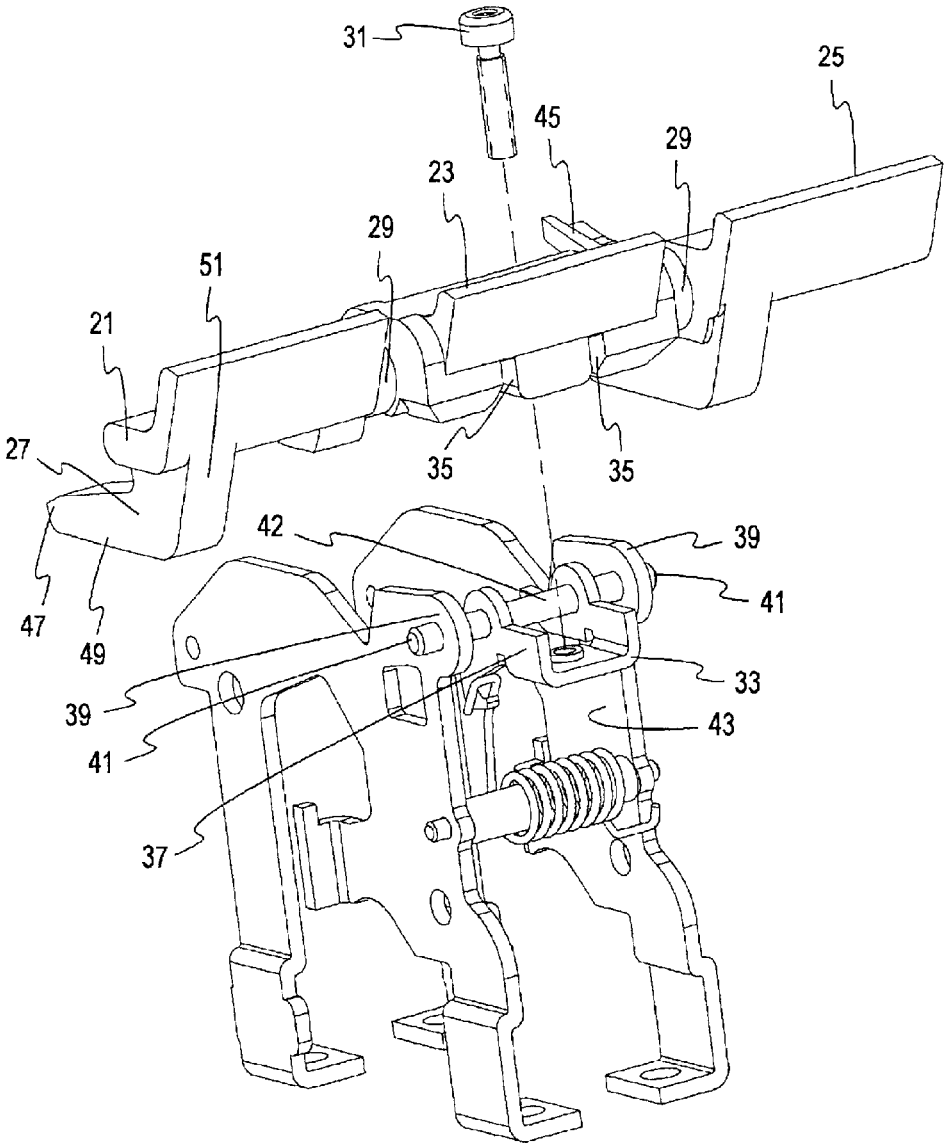
FIG. 5 is a perspective exploded view of the trip cross bar assembly in the circuit breaker of FIG. 1.

One aspect of the invention is the trip cross bar 21, which is more clearly shown in FIG. 5. The trip cross bar 21 is a molded plastic part that is separated into three segments, which are integrated into one single part. A middle segment 23 acts as a bridge between a left segment 25 and a right segment 27, being connected to each segment by a semicircular rod 29. The middle segment 23 is molded, generally, in the shape of a rectangular cube, with various cuts and notches that will be explained below. Centered with respect to both the long and the narrow dimensions, along the top surface, the middle segment 23 has a drilled-through counterbored hole. A screw 31 is used to secure the trip cross bar 21 to a latch 33 by inserting the screw 31 through the counterbored hole of the middle segment 23 and threading the screw 31 into a threaded hole in the latch.

Two identical latch slots 35 are cut into the bottom of the middle segment 23 of the trip cross bar 21 to allow the mating of the latch main body 37 with the middle segment 23. Specifically, the latch slots 35 of the middle segment 23 fit over mating walls on the latch main body 37. Also on the bottom of the middle segment 23, two major circular slots are cut to accommodate the curved vertical frame ends 39, and two minor circular slots are cut to accommodate the pin ends 41 of the supporting pin 42. Plastic material is molded to the middle segment 23 next to each semicircular rod 29 in order to engulf most of the metal area near the curved ends 39 of the frame 43. Furthermore, the semicircular rods 29, which are formed on both sides of the middle segment 23, serve as a lock to prevent the supporting pin 42 from sliding out of the frame 43.

Although the trip cross bar 21 is allowed to rotate around the supporting pin 42, a stop tab 45 is formed on the left side of the middle segment 23 to engage the flat metal edge of the frame 43 that continues from the curved frame end 39. Alternatively, the stop tab 45 can also be formed on the right side of the middle segment 23.

The segments 25 and 27 are identical in shape, having a generally V-shaped profile that continues throughout the entire segment length. A finger 47 is formed on the bottom side of each segment 25 and 27 for activating the blade mechanism 7. Each finger 47 has an L-shaped profile with the activating side 49 being longer than finger-connecting side 51. The segment 27 is connected to the middle segment 23 on the finger 47 side, while the segment 25 is connected to the middle segment 23 on the side opposite where the finger 47 is located, thus giving a non-symmetrical shape to the trip cross bar 21. When enough heat is generated in the circuit breaker 1, i.e., a temperature above a predetermined threshold temperature that is considered adequate for the normal operation of the circuit breaker 1, a bimetal (not shown) bends and engages and pivots the trip cross bar 21. The handle mechanism 5 and the blade mechanism 7 are both affected by the pivoting motion of the trip cross bar 21 which rotates slightly in a counterclockwise direction, as viewed in FIG. 4. The handle 17 resumes its "tripped" position, and the movable contact 11 separates from the stationary contact 15, thereby interrupting the flow of electric current in the electrical system controlled by circuit breaker 1.

Using top down assembly, the trip cross bar 21 is the last component to be installed by securing it with only one screw 31 to the latch 33, which can be preassembled to the frame 43 by using the supporting pin 42. Because the trip cross bar 21 is the last component to be installed, this invention allows other components to be installed when assembly in tight spaces is required. This is particularly useful in the assembly of circuit breakers that have a relatively small size. The size and shape of the trip cross bar 21 allows its easy insertion after all components have been installed, and with the use of a simple tool, such as a screwdriver, it can be securely attached to the frame 43 by using the screw 31. Furthermore, given the simplicity of this assembly method, automated assembly is facilitated.

Figure 6:
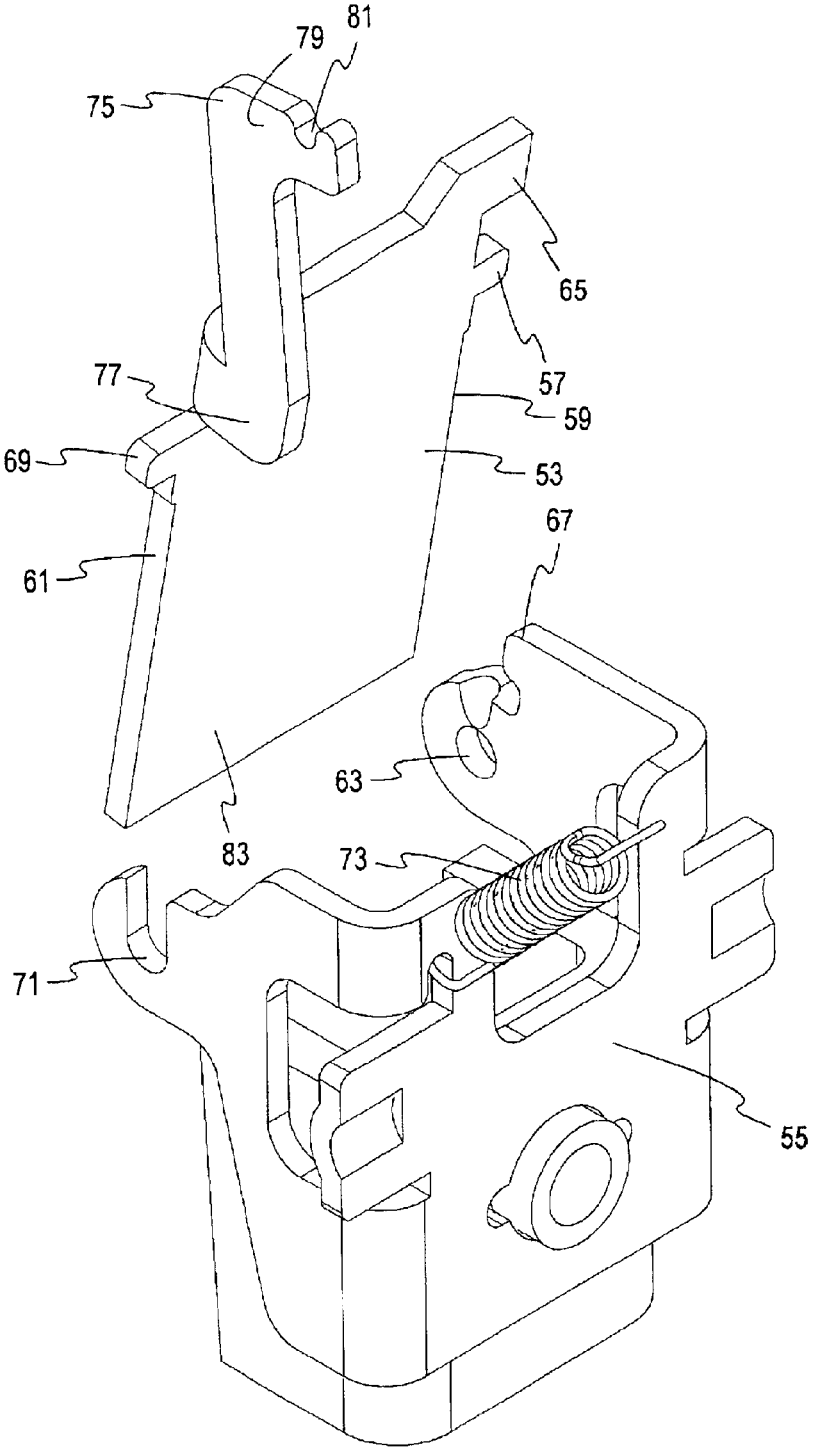
FIG. 6 is a perspective view showing the components of the magnetic trip armature assembly.

Another aspect of the invention involves the tripping mechanism 3 and, more specifically, one of its components, namely, a magnetic trip armature 53, which is shown in FIG. 6. The trip armature 53 is connected to an armature frame 55 in three locations that allow an easy assembly and securing method. The first connecting location is a pivoting projection 57 that is located on the pivoting side 59 of the trip armature 53. Although pivoting projection 57 constrains translational motion of the pivoting side 59, it allows rotational motion of the trip armature 53. The dimensions of the projection 57 are small enough to allow its insertion into a mating pivoting hole 63 in the armature frame 55. Located next to the pivoting projection 57 is a rectangular stop protrusion 65, which abuts a stop surface 67 on the armature frame 55 to prevent the trip armature 53 from rotating in the clockwise direction.

The second connecting location is a constraining protrusion 69 that is located opposite the pivoting projection 57 on the trip armature 53, and that is similar in size and shape to the pivoting projection 57. The constraining protrusion 69 is slipped into a armature slot 71 in the armature frame 55 during assembly in order to constrain translation motion of the trip armature 53 in a horizontal direction and in a downward direction, away from the return spring 73.

The third connecting location is provided by a spring arm 75 that has a first end 77 near the constraining protrusion 69, and that extends upward, away from the main body of trip armature 53, in an inverted L-shaped configuration. A second end 79, forming the short, bottom end of the inverted L-shaped configuration, has a small spring notch 81 on the side farthest away from the main body of the trip armature 53 for accommodating a return spring 73. Hooking one end of the return spring 73 into the spring notch 81 prevents the trip armature 53 from sliding out of the armature slot 71, while allowing the trip armature 53 to function rotationally as required by the tripping mechanism 3.

When the current is higher than the preset current level of the circuit breaker 1 and the current intensity is sustained over a specified period of time, an electromagnetic force is generated that allows a magnetized pole (not shown) to attract a main armature surface 83 causing it to rotate in a counterclockwise direction as viewed in FIG. 1. The electromagnetic force is strong enough to overcome the force applied by the return spring 73 on the trip armature 53 and, therefore, to cause the spring arm 75 to engage the trip cross bar 21 which, in turn, actuates the handle mechanism 5 and the blade mechanism 7. The end result is that the handle 17 responds by moving to the "tripped" position and the movable contact 11 separates from the stationary contact 15, thereby interrupting the flow of electric current.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker for interrupting the flow of current upon the detection of excess current or temperature, comprising:

a housing, a trip armature plate having at least two pivot tabs extending laterally on opposite edges and a stop tab located proximate one of said two pivot tabs, a trip armature frame having a pivot elongated slot at an open end and a pivot hole at the opposite end for retaining said pivot tabs, and a bias spring for securing said pivot tabs in said pivot elongated slot and pivot aperture and for urging said armature plate pivotably outwardly about said tabs away from said armature frame.

2. The circuit breaker of claim 1, further comprising:

a circuit breaker trip mechanism, and a trip cross bar having a single fastener located in a central position for allowing a tripping motion by contact with any part of said cross bar.

3. The circuit breaker of claim 2, further comprising:

at least one optional circuit breaker accessory, and a trip cross bar having at least two fingers for engaging said accessory, said fingers being asymmetrically located to allow the interchangeability of said accessory.

* * * * *